US007444970B2

(12) United States Patent
Ogawa

(10) Patent No.: US 7,444,970 B2
(45) Date of Patent: Nov. 4, 2008

(54) VALVE TIMING CONTROLLING APPARATUS

(75) Inventor: Kazumi Ogawa, Toyota (JP)

(73) Assignee: Aisin Seiki Kabushiki Kaisha, Kariya, Aichi (JP)

( * ) Notice: Subject to any disclaimer, the term of this patent is extended or adjusted under 35 U.S.C. 154(b) by 0 days.

(21) Appl. No.: 11/659,839

(22) PCT Filed: Sep. 14, 2005

(86) PCT No.: PCT/JP2005/016939

§ 371 (c)(1),
(2), (4) Date: Feb. 9, 2007

(87) PCT Pub. No.: WO2006/035602

PCT Pub. Date: Apr. 6, 2006

(65) Prior Publication Data

US 2007/0266970 A1 Nov. 22, 2007

(30) Foreign Application Priority Data

Sep. 28, 2004 (JP) ..... 2004-281909

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 6,439,184 | B1 | 8/2002 | Takenaka et al. |
| 6,662,769 | B2 | 12/2003 | Eguchi et al. |
| 2002/0100445 | A1 | 8/2002 | Takenaka et al. |
| 2002/0152977 | A1 | 10/2002 | Eguchi et al. |
| 2004/0182342 | A1 | 9/2004 | Nakajima |

FOREIGN PATENT DOCUMENTS

| | | | |
|---|---|---|---|
| JP | 2002-227621 | A | 8/2002 |
| JP | 2002-276312 | A | 9/2002 |
| JP | 2003-120229 | A | 4/2003 |
| JP | 2004-204726 | A | 7/2004 |

*Primary Examiner*—Zelalem Eshete
(74) *Attorney, Agent, or Firm*—Buchanan Ingersoll & Rooney PC

(57) ABSTRACT

In a valve timing controlling apparatus having: a first rotary body rotatable with a cam shaft of an internal combustion engine; a second rotary body rotatable with a crank shaft and rotatable relative to the first rotary body; a controlling means for varying relative rotational phase between the first rotary body and the second rotary body; and a torsion coil spring for urging the first rotary body relative to the second rotary body in a phase advancing direction. The coil portion 22 of the torsional coil spring 20 includes a pair of holding areas 23*a*, 23*b* extending continuously from the respective retaining portions and capable of fixing the coil portion in position relative to the first rotary body 1 and the second rotary body 2 and includes also a torque generating area 25 disposed between the pair of holding area. The holding areas and the torque generating area have different coiling diameters.

6 Claims, 5 Drawing Sheets

VALVE TIMING CONTROLLING APPARATUS

TECHNICAL FIELD

The present invention relates to a valve timing controlling apparatus including a first rotary body rotatable with a cam shaft of an internal combustion engine, a second rotary body rotatable with a crank shaft and rotatable relative to the first rotary body, a controlling means for varying relative rotational phase between the first rotary body and the second rotary body, and a torsion coil spring for urging the first rotary body relative to the second rotary body in a phase advancing direction.

BACKGROUND ART

Normally, when an internal combustion engine having a valve timing controlling apparatus is operated, the cam shaft receives resistance from a valve spring. Therefore, the relative phase of the first rotary body rotatable together with the cam shaft tends to be lagged, relative to the rotation of the second rotary body rotatable together with the crank shaft. In order to solve such phase lag, the conventional valve timing controlling apparatus includes a torsion coil spring for urging the first rotary body to the advancing side relative to the second rotary body.

Another purpose of providing such torsion coil spring relates to startup of the internal combustion engine. The startup is often effected with hydraulically locking the first rotary body and the second rotary body under a predetermined phase condition. However, at the time of startup, the oil supply is insufficient for effecting the phase control, so that the locking can be difficult because the first rotary body tends to move back and forth relative to the second rotary body. In particular, when the first rotary body is located on the lagging side, the resistance applied to the cam shaft resists advancing of the first rotary body, so that the locking cannot be done speedily. For this reason, the torsion coil spring is provided for enabling the apparatus to effect the locking operation speedily.

An example of the valve timing controlling apparatus of the above-noted type is known from Patent Document 1 identified blow, shown as Prior-Art Document Information relating to the present invention. In the case of the valve timing controlling apparatus disclosed in this Patent Document 1, there is provided a gap between a coil spring portion of the torsion coil spring and the respective peripheral face of the first rotary body or the second rotary body. With this, even when the coil spring portion is reduced in its inner diameter during relative rotation between the first rotary body and the second rotary body, it is possible to avoid the trouble that excessive frictional resistance generated due to contact between the coil spring portion of the torsion coil spring and the respective peripheral face prevents the torsion coil spring from exerting its initial set spring force.

Patent Document 1: Japanese Patent Application "Kokai" No. 2002-276312 (paragraphs: 0014, 0032, and FIG. 1).

DISCLOSURE OF THE INVENTION

Problem to be Solved by Invention

However, with the valve timing controlling apparatus disclosed by Patent Document 1, if there occurs such deformation in the torsion coil spring that causes inclination of its axis relative to the axis of the first/second rotary body in response to the relative rotation between the first rotary body and the second rotary body, contact can still occur between coil spring portion and the peripheral face of the rotary body in spite of the provision of the gap. Furthermore, the coil spring portion is formed like a cylinder having a constant coiling diameter along the entire length thereof. Hence, it is difficult to foresee what particular part of this coil spring portion can contact the peripheral face of the rotary body. For instance, there is the risk of such contact occurring between the central part of the coil spring portion and the rotary body. In such case, as the central part and its vicinity are moved relative to the rotary body by a greater amount, compared with the remaining part of the coil spring portion, the contact, if occurred, will significantly influence the appropriate control of the valve timing.

Therefore, in view of the above-described drawbacks of the valve timing controlling apparatus according to the conventional technique, the object of the present invention is to provide a valve timing controlling apparatus capable of avoiding the trouble that excessive frictional resistance generated due to contact between the coil spring portion of the torsion coil spring and the rotary body prevents the torsion coil spring from exerting its set spring force.

Means to Achieve the Object

For accomplishing the above-noted object, according to a first characterizing feature of the present invention, there is proposed a valve timing controlling apparatus comprising a first rotary body rotatable with a cam shaft of an internal combustion engine; a second rotary body rotatable with a crank shaft and rotatable relative to the first rotary body; a controlling means for varying relative rotational phase between the first rotary body and the second rotary body; and a torsion coil spring for urging the first rotary body relative to the second rotary body in a phase advancing direction;

wherein said torsion coil spring includes a pair of retaining portions to be retained respectively to said first rotary body and said second rotary body and a coil portion disposed between said pair of retaining portions; and wherein said coil portion includes a pair of holding areas extending continuously from said respective retaining portions and capable of fixing said coil portion in position relative to respective peripheral faces of said first rotary body and said second rotary body formed coaxially with a rotational axis of said first and second rotary bodies and includes also a torque generating area disposed between said pair of holding areas, said holding areas and said torque generating area having different coiling diameters from each other.

With the above described characterizing construction, as the holding areas and the torque generating area have different coiling diameters from each other, the torque generating area is constantly urged radially outwardly or inwardly away from the periphery of the rotary body to which the corresponding retaining portion is retained. Therefore, even when a portion or entirety of the torque generating area is moved closer to either rotary body with radial expansion or contraction of the coil portion which occurs in association with a relative rotation between the first rotary body and the second rotary body, the torque generating area can be kept constantly apart radially outwardly or inwardly from the periphery of the rotary body to which the corresponding retaining portion is retained. As a result, the torque generating area is free from friction from the peripheral face of the first or second rotary body, so that the torsion coil spring can exert its set spring force, thus effectively controlling the valve timing.

Incidentally, the length of the retaining area will vary, depending on e.g. the curvature of the rotary body, the shape of the torsion coil spring, etc. For example, in some cases, only an extreme vicinity of the retaining portion will form and act as the holding area. In other cases, the holding area will have a length of half (180°) a winding of the torsion coil spring. The holding area provides the function of keeping the torque generating area away from each rotary body in the event of torsional deformation of the torsion coil spring occurring in association with the relative rotational displacement between the first rotary body and the second rotary body. The holding area is constituted by a coiling part in extreme vicinity of the retaining portion. Therefore, during such torsional deformation of the torsion coil spring, there will occur only a very small amount of movement or displacement therein relative to the retaining portion or the rotary body. And, even if the holding area should come into contact with the rotary body, the influence from this contact will be negligibly small. On the other hand, the torque generating area is farther from the retaining portion than the holding area is. Therefore, during the torsional deformation of the torsion coil spring, the torque generating area will be displaced relative to the retaining portion or the rotary body by a greater amount. Hence, if the torque generating area contacts the rotary body, this contact will provide a significant influence. Therefore, in order to allow the torsion coil spring to exert its set spring force, it is necessary to prevent effective contact between the torque generating area and the rotary body.

According to a second characterizing feature of the present invention, said pair of holding areas fix said coil portion in position relative to respective peripheral faces of said first rotary body and said second rotary body by coming into contact with the respective peripheral faces of the first rotary body and the second rotary body for a range within one winding from each said retaining portion.

With this characterizing feature, as the holding areas come into contact with the respective peripheral faces, the coil portion can be fixed in position relative to the rotary bodies in an even more reliable manner. Further, since the range of contact is confined to the range within one winding from each retaining portion, the contacting portion does not provide any adverse effect to the movements of the rotary bodies due to the friction with the peripheral faces of these rotary bodies.

According to a third characterizing feature of the present invention, of a plurality of windings forming said torque generating area, adjacent windings adjacent along the axial direction of the torsion coil spring are maintained under a non-contact condition, regardless of a relative positional relationship between said first rotary body and said second rotary body.

With the above characterizing feature, even when the torsion coil spring is tightened or loosened due to torsional forces applied to the two retaining portions of the torsion coil spring, adjacent windings constituting the torque generating area are always maintained under the non-contact condition. Therefore, there will be generated no frictional force between the windings constituting the torque generating area, so that the torsion coil spring can exert its set spring force in an even more reliable manner.

According to a fourth characterizing feature of the present invention, one of said pair of retaining portions of the torsion coil spring is retained to an outer peripheral face of one of the first and second rotary bodies which is disposed on the inner side of the torsion coil spring; the other retaining portion is retained to an inner peripheral face of the other one of the first and second rotary bodies which is disposed on the outer side of the torsion coil spring; and said torque generating area has a coiling diameter greater than the holding area extending continuously from said one retaining portion retained to said outer peripheral face and smaller than the other holding area extending continuously from the other retaining portion retained to said inner peripheral face.

With the above-described characterizing feature, since the torque generating area has a coiling diameter greater than the holding area extending continuously from the one retaining portion retained to the outer peripheral face of the rotary body, the torque generating area is always kept radially outwardly away from the outer peripheral face of this rotary body. Further, since the torque generating area has a coiling diameter smaller than the other holding area extending continuously from the other retaining portion retained to said inner peripheral face, the torque generating area is always kept radially inwardly away from the inner peripheral face of this rotary body. Therefore, even when a portion or entirety of the torque generating area is moved closer to either rotary body in association with a relative rotation between the first rotary body and the second rotary body, the torque generating area can always be kept at a position radially inwardly or outwardly away from the holding area. As a result, the torque generating area does not come into contact with the peripheral face of the first or second rotary body, so that the torsion coil spring can exert its set spring force, thus effectively controlling the valve timing.

According to a fifth characterizing feature of the present invention, said pair of retaining portions of the torsion coil spring are both retained to the inner peripheral faces of said first and second rotary bodies which are disposed on the outer side of the torsion coil spring; and said torque generating area has a coiling diameter smaller than either one of said pair of holding areas extending continuously from the respective retaining portions.

With the above-described characterizing feature, as the coiling diameter of the torque generating area is smaller than that of either one of the holding areas, the entire windings constituting the torque generating area are always kept radially inwardly away from the inner peripheral faces of the rotary bodies. Therefore, even when a portion or entirety of the torque generating area is moved closer to either rotary body in association with a relative rotation between the first rotary body and the second rotary body, contact between the torque generating area and the peripheral face of the first or second rotary body can be avoided reliably, so that the torsion coil spring can exert its set spring force, thus effectively controlling the valve timing.

According to a sixth characterizing feature of the present invention, said pair of retaining portions of the torsion coil spring are both retained to the outer peripheral faces of the inner peripheral faces of said first and second rotary bodies which are disposed on the inner side of the torsion coil spring; and said torque generating area has a coiling diameter greater than either one of said pair of holding areas extending continuously from the respective retaining portions.

With the above-described characterizing feature, as the coiling diameter of the torque generating area is greater than that of either one of the holding areas, the entire windings constituting the torque generating area are always kept radially outwardly away from the outer peripheral faces of the rotary bodies. Therefore, even when a portion or entirety of the torque generating area is moved closer to either rotary body in association with a relative rotation between the first rotary body and the second rotary body, contact between the torque generating area and the peripheral face of the first or second rotary body can be avoided reliably, so that the torsion coil spring can exert its set spring force, thus effectively controlling the valve timing.

BEST MODE OF EMBODYING THE INVENTION

An embodiment of the present invention will be described with reference to the accompanying drawings.

FIGS. 1 and 2 are schematics showing a condition where a valve timing controlling apparatus of the invention is employed for an internal combustion engine. FIG. 1 is a section of the valve timing controlling apparatus 1 taken along its the axial direction. FIG. 2 is a section taken along a line A-A in FIG. 1.

As shown in FIG. 1, the valve timing controlling apparatus 1 includes an inner rotor 1 (an example of "first rotary body") and an outer rotor 2 (an example of "second rotary body") rotatable relative to the inner rotor 1. The inner rotor 1 is fixed, via a cam set bolt 3, to a cam shaft 50 of the internal combustion engine to be rotatable therewith. The outer rotor 2 includes a housing member 5 surrounding the inner rotor 1 radially outwardly thereof, and front and rear plates 6, 7 which are attached to the housing member 5 with attaching bolts 8. The rear plate 7 defines, in its outer periphery, a sprocket portion 7*a*. This sprocket portion 7*a* meshes with a drive transmitting member (not shown) such as an endless belt, which is rotatably driven by a crank shaft (not shown) of the internal combustion engine.

As shown in FIG. 2, in the inner peripheral side of the housing member 5, there are formed a plurality of recesses 5*a*. These recesses 5*a* constitute, together with the outer peripheral face of the inner rotor 1, fluid chambers 10 for receiving control oil to be described later. In the outer peripheral face of the inner rotor 1, there are defined a plurality of attaching grooves 1*c* in which a plurality of plate-like vanes 12 are attached and urged radially outwards therefrom by means of vane springs 12 *a* (see FIG. 1) mounted at the bottoms of the respective attaching grooves 1*c*. Each vane 12 partitions the corresponding fluid chamber 10 between a phase advanced angle chamber 10*a* and a phase retarded angle chamber 10*b*. The inner rotor 1 defines phase advancing oil passages 1*a* communicating with the respective advanced angle chambers 10*a* and phase lagging oil passages 1*b* communicating with the respective retarded angle chambers 10*b*, with these passages 1*a*, 1*b* extending radially through the inner rotor 1. Incidentally, the respective advancing oil passages 1*a* each other and the respective lagging oil passages 1*b* each other are combined respectively with a single advancing oil passage and a single lagging oil passage within an oil feeding boss 4 disposed at the center of the inner rotor 1.

These phase advancing oil passages and phase lagging oil passages are communicated via a solenoid valve (not shown) with an oil pan of the internal combustion engine. This solenoid valve controls the amount of oil to be supplied from the oil pan to the advanced angle chamber 10*a* and the retarded angle chamber 10*b*, thus adjusting the volumetric ratio between the phase advanced angle chamber 10*a* and the phase retarded angle chamber 10*b*. With this, the position of each vane 12 inside the fluid chamber 10 is controlled between a phase lagging side end face 11*a* and a phase advancing side end face 11*b* inside the fluid chamber 10, thus adjusting the rotational phase of the inner rotor 1 relative to the outer rotor 2. As a result, the opening/closing timing of the valve driven by the cam shaft 50 can be adjustably controlled relative to the rotational phase of the crank shaft. More particularly, as the inner rotor 1 is moved relative to the outer rotor 2 in the direction for increasing the volume of the phase advanced angle chamber 10*a* (arrow R1), the valve timing is advanced relative to the rotational phase of the crank shaft. Conversely, as the inner rotor 1 is moved relative to the same in the direction for increasing the volume of the phase retarded angle chamber 10*b* (arrow R2), the valve timing is lagged.

The section taken along the arrow B-B in FIG. 1 is shown in FIG. 3. As shown, between the inner rotor 1 and the outer rotor 2, there is provided a torsion coil spring 20. One function of this torsion coil spring 20 is to urge the inner rotor 1 to the phase advancing side. Namely, this function is provided for solving the phase lagging tendency of the cam shaft relative to the outer rotor due to resistance from the valve spring.

The torsion coil spring 20 functions also to smooth the startup operation of the internal combustion engine. For obtaining the optimal valve timing at the time of startup of the internal combustion engine, it is preferred that the startup be effected at a lock position between a phase advancing angle and a phase lagging angle. For instance, the spring urges the inner rotor to the advancing side so that the inner rotor may assume the lock position when the inner rotor is located on the lagging side when the internal combustion engine is stopped.

FIG. 4 shows the torsion coil spring 20 when removed from the valve timing controlling apparatus 1 and free from application of any external force thereto. The torsion coil spring 20 includes a pair of retaining portions 21*a*, 21*b* to be retained to the inner rotor 1 and the outer rotor 2 respectively, and a spiral coil portion 22 located between the pair of retaining portions 21*a*, 21*b*. In the instant embodiment, the first retaining portion 21*a* to be retained to the inner rotor 1 has a radially inwardly bent hook shape, whereas the second retaining portion 21*b* to be retained to the outer rotor 2 has a radially outwardly bent hook shape. Further, the coil portion 22 has a tapered configuration with a progressively increasing outer diameter downwardly along the direction of axis X of the torsion coil spring 20.

Between the inner peripheral face of the rear plate 7 and the outer peripheral face of the inner rotor 1 radially opposed thereto, there is formed an annular spring chamber for accommodating the torsion coil spring 20. And, at one portion of the outer peripheral face of the inner rotor 1, there is formed a retained portion 1E which extends radially for receiving the first retaining portion 21*a*. On the other hand, at one portion of the inner peripheral face of the outer rotor 2, there is formed a retained portion 2E which extends radially for receiving the second retaining portion 21*b*.

For attaching the torsion coil spring 20 to the valve timing controlling apparatus 1, the coil spring 20 will be twisted so as to displace the first retaining portion 21*a* away from the second retaining portion 21*b* along the peripheral direction in the direction of arrow C and under this condition, the first retaining portion 21*a* will be retained to the retained portion 1E and the second retaining portion 21*b* will be retained to the retained portion 2E, respectively. Therefore, upon completion of the attachment, the torsion coil spring 20 exerts a resilient urging force to rotationally urge the inner rotor 1 relative to the outer rotor 2 in the direction of arrow D. With this, the relative position between the inner rotor 1 and the outer rotor 2 will be maintained under the most advanced phase condition where the volume of the advanced angle chamber 10*a* is at its maximum and the vane 12 is pressed against the phase advancing side end face 11*b*.

As shown in FIG. 3, when being attached to the valve timing controlling apparatus 1, the coil portion 22 includes a first holding area 23*a* extending continuously from the first retaining portion 21*a* and extending with a curve along the outer peripheral face of the inner rotor 1, a second holding area 23*b* extending continuously from the second retaining portion 21*b* and extending with a curve along the inner peripheral face of the outer rotor 2, and a torque generating area 25 disposed between the first holding area 23*a* and the second holding area 23*b*. And, the first and second holding areas 23*a*, 23*b* and the torque generating area 25 have different coiling diameters from each other.

As a result, the torque generating area 25 is constantly kept away from the inner rotor 1 and the outer rotor 2 by means of the first holding area 23*a* and the second holding area 23*b*.

Incidentally, in the condition illustrated in FIG. 3, the first holding area 23*a* and the second holding area 23*b* are apart from the inner rotor 1 and the outer rotor 2, respectively. However, in the event of "squeezing" torsional deformation of the torsion coil spring 20 in association with relative rotation of the inner rotor 1 to the phase lagging side, e.g. the first holding area 23*a* will come into contact with the outer peripheral face of the inner rotor 1, thus providing additional stability to the posture of the torsion coil spring 20.

For instance, for attaching the torsion coil spring 20 to the valve timing controlling apparatus 1, the spring 20 will be torsionally deformed so as to separate the first retaining portion 21*a* away from the second retaining portion 21*b* along the peripheral direction in the direction of arrow C, so that with this torsional deformation, the torque generating area 25 will be reduced in its coiling diameter in some of its windings. However, in this case too, the torque generating area 25 will not come into contact with the outer peripheral face of the inner rotor 1. On the other hand, when oil is supplied into the phase advanced angle chamber 10*a* thereby to operate the inner rotor 1 into the most phase advanced condition, the torsion coil spring 20 is deformed and the coiling diameter of the torque generating area 25 is increased. However, in this case too, the torque generating area 25 will not come into contact with the inner peripheral face of the outer rotor 2.

Further, even if there occurs a torsional deformation causing slackening or tightening in the coil portion 22 of the torsion coil spring 20 due to torsional vibration associated with relative rotation between the inner rotor 1 and the outer rotor 2, the torque generating area 25 will not contact the outer peripheral face of the inner rotor 1 or the inner peripheral face of the outer rotor 2.

Of the windings forming the torque generating area 25, the windings adjacent each other along the direction of the axis X of the torsion coil spring 20 are arranged so as to maintain the non-contact condition, regardless of the relative positional relationship between the inner rotor 1 and the outer rotor 2.

Incidentally, in this embodiment, because of the small number of its windings, the torque generating area 25 presents a tapered appearance with the coiling diameter varying, with a constant rate, along the direction of the axis X of the torsion coil spring 20. However, in case there are a large number of windings therein, the torque generating area 20 may exhibit a cylindrical shape at its center portion with invariable coiling diameter relative to the axial direction.

OTHER EMBODIMENTS

<1> In FIG. 3 relating to the foregoing embodiment, there is shown the condition where the substantially entire coil portion 22 of the torsion coil spring 20 is radially apart from the outer peripheral face of the inner rotor 1 and the inner peripheral face of the outer rotor 2. However, as shown in FIG. 5, a further arrangement is possible wherein regardless of the relative rotational phase between the inner rotor 1 and the outer rotor 2, a portion of the torsion coil spring 20 is constantly pressed against the outer peripheral face of the inner rotor 1, thus acting as the first holding area 23*a*, whereas a further portion of the torsion coil spring 20 is constantly pressed against the inner peripheral face of the outer rotor 2, thus acting as the second holding area 23*b*. With this further arrangement, the postures of the first holding area 23*a* and the second holding area 23*b* relative to the respective peripheral faces of the inner rotor 1 and the outer rotor 2 may be further stabilized.

<2> In the foregoing embodiment, the first retaining portion 21*a* of the torsion coil spring 20 is retained to the outer peripheral face of the inner rotor 1, whereas the second retaining portion 21*b* is retained to the inner peripheral face of the outer rotor 2. Further, because of the relatively small number of windings thereof, the coil portion 22, as a whole, presents the tapered shape. However, in some cases, there may be employed a torsion coil spring 120 having a cylinder shape with a tapered center. Namely, in this case, both a first retaining portion 121*a* and a second retaining portion 121*b* of the torsion coil spring 120 have a hook shape extending radially outward. And, the first retaining portion 121*a* and the second retaining portion 121*b* are retained respectively to the respective inner peripheral faces of the inner rotor and the outer rotor.

When this torsion coil spring 120 is attached to the valve timing controlling apparatus, a coil portion 122 thereof located between the pair of retaining portions 121*a*, 121*b* forms three areas. Namely, one is a first holding area 123*a* which extends from the first retaining portion 121*a* to come into contact with the inner peripheral face of the inner rotor, thus fixing the coil portion 122 in position relative to this inner peripheral face. Another is a second holding area 123*b* which extends from the second retaining portion 121*b* to come into contact with the inner peripheral face of the rotation transmitting member, thus fixing the coil portion 122 in position relative to this inner peripheral face. And, the other is a torque generating area 125 disposed between the first holding area 123*a* and the second holding area 123*b*.

The coiling diameter of the torque generating area 125 is smaller than the coiling diameters of the respective holding areas 123*a*, 123*b* and the axial center portion of the torsion coil spring 120 is reduced in its diameter, thus presenting the center-tapered cylinder shape. As a result, due to the first holding area 123*a* and the second holding area 123*b*, the torque generating area 125 is constantly kept radially inwardly away from the inner peripheral faces of the inner rotor and the outer rotor.

<3> Conversely from the embodiment shown in FIG. 6, as illustrated in FIG. 7, there may be employed a barrel-like torsion coil spring 220 having an axial center portion increased in its diameter. Namely, in this case, both a first retaining portion 221*a* and a second retaining portion 221*b* of the torsion coil spring 220 have a hook shape extending radially inward. The first retaining portion 221*a* and the second retaining portion 221*b* are retained respectively to the respective outer peripheral faces of the inner rotor and the outer rotor.

When this torsion coil spring 220 is attached to the valve timing controlling apparatus, a coil portion 222 located between the pair of retaining portions 221*a*, 221*b* forms a first holding area 223*a* contactable with the outer peripheral face of the inner rotor, a second holding area 223*b* contactable with the outer peripheral face of the outer rotor, and a torque generating area 225 disposed between the first holding area 223*a* and the second holding area 223*b*.

The coiling diameter of the torque generating area 225 is greater than the coiling diameters of the first and second holding areas 223*a*, 223*b*, so that the torsion coil spring 220 presents the barrel-like shape having the axial center portion with the increased diameter. As a result, the torque generating area 225 is constantly kept radially outwardly away from the outer peripheral faces of the inner rotor and the outer rotor.

INDUSTRIAL APPLICABILITY

The present invention can be applied as a technique for determining a preferred shape of a torsion coil spring for use in a valve timing controlling apparatus including a first rotary body rotatable with a cam shaft of an internal combustion engine, a second rotary body rotatable relative to the first rotary body, a controlling means for varying relative rotational phase between the first rotary body and the second rotary body, and a torsion coil spring for urging the first rotary body relative to the second rotary body in a phase advancing direction.

DESCRIPTION OF REFERENCE MARKS

Figure 1:
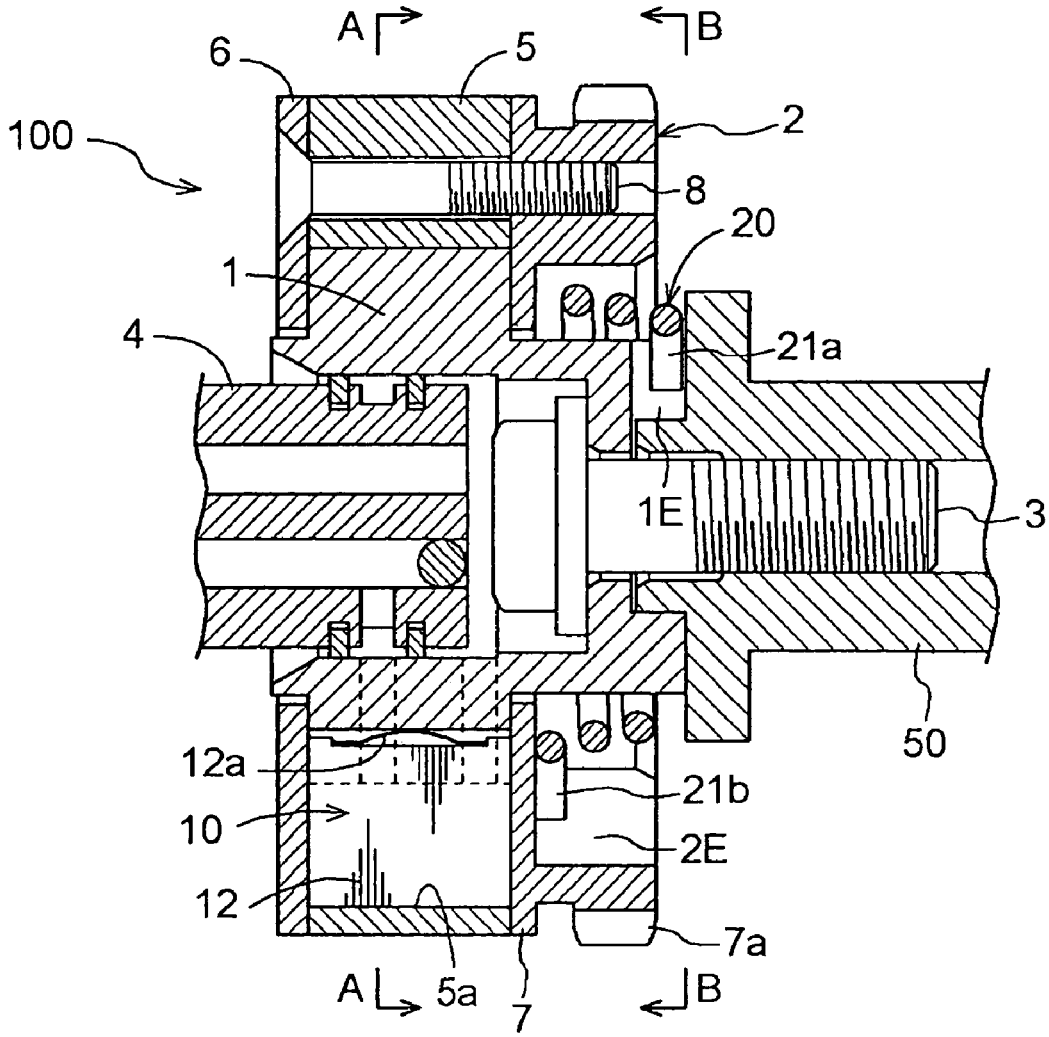
[FIG. 1] a side view in section showing a valve timing controlling apparatus of the invention taken along the direction of its axis.
Figure 2:
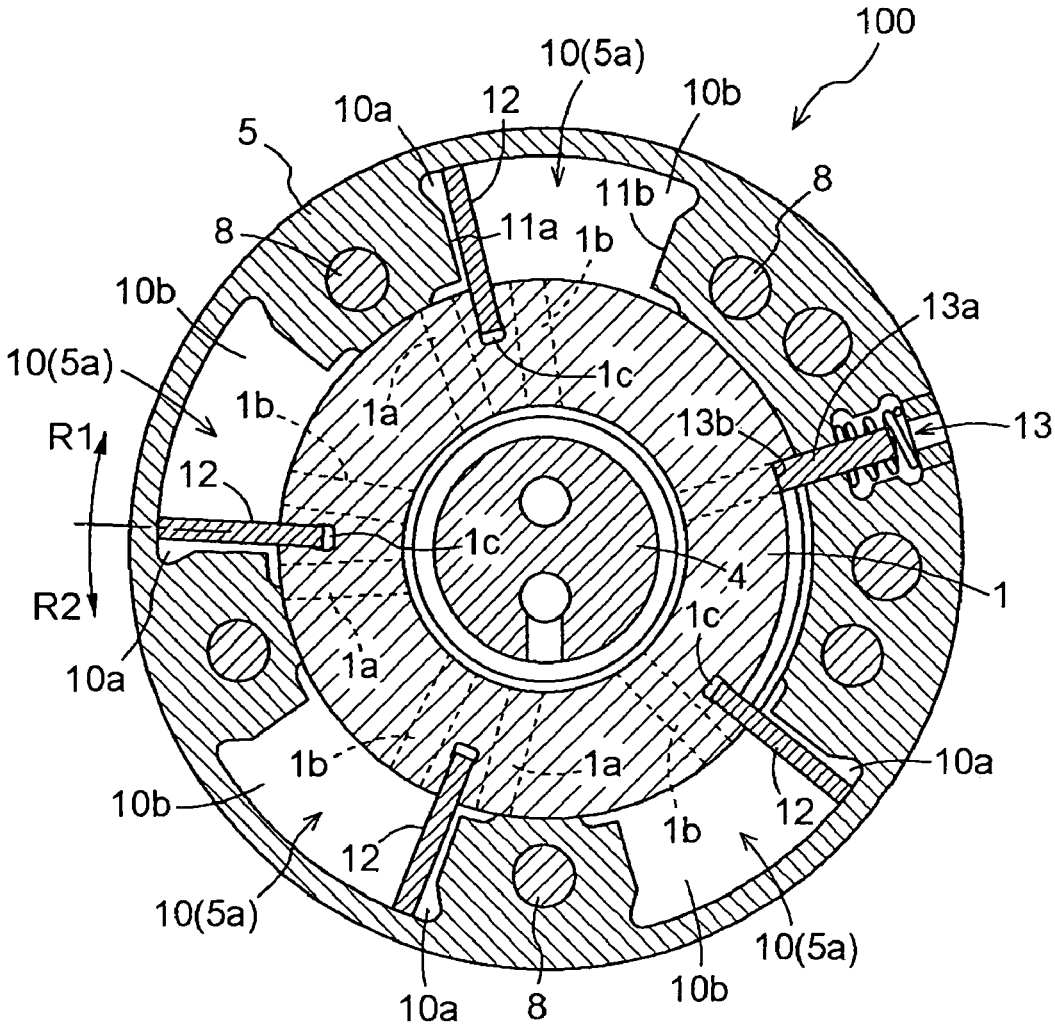
[FIG. 2] a front view in section showing the valve timing controlling apparatus shown in FIG. 1 taken along a direction of arrow A-A.
Figure 3:
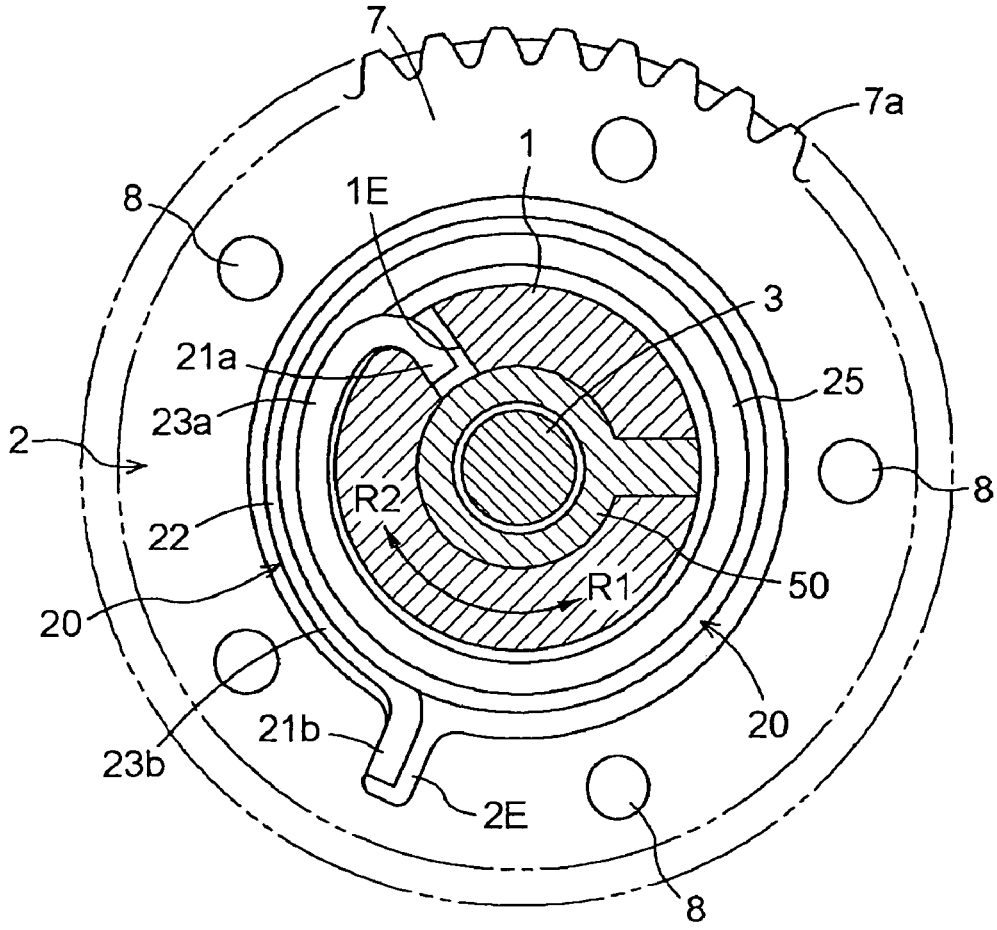
[FIG. 3] a front view in partial section showing the valve timing controlling apparatus taken along a direction of arrow B-B.
Figure 4:
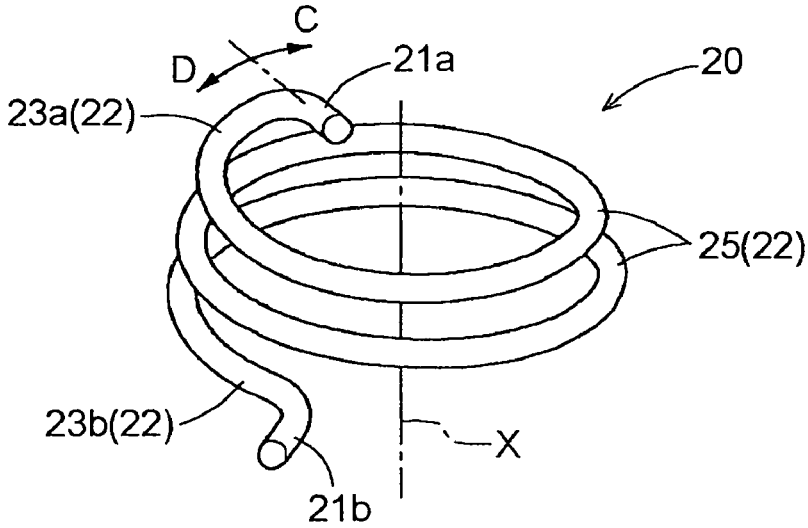
[FIG. 4] a perspective view showing a torsion coil spring for use in the valve timing controlling apparatus shown in FIG. 1.
Figure 5:
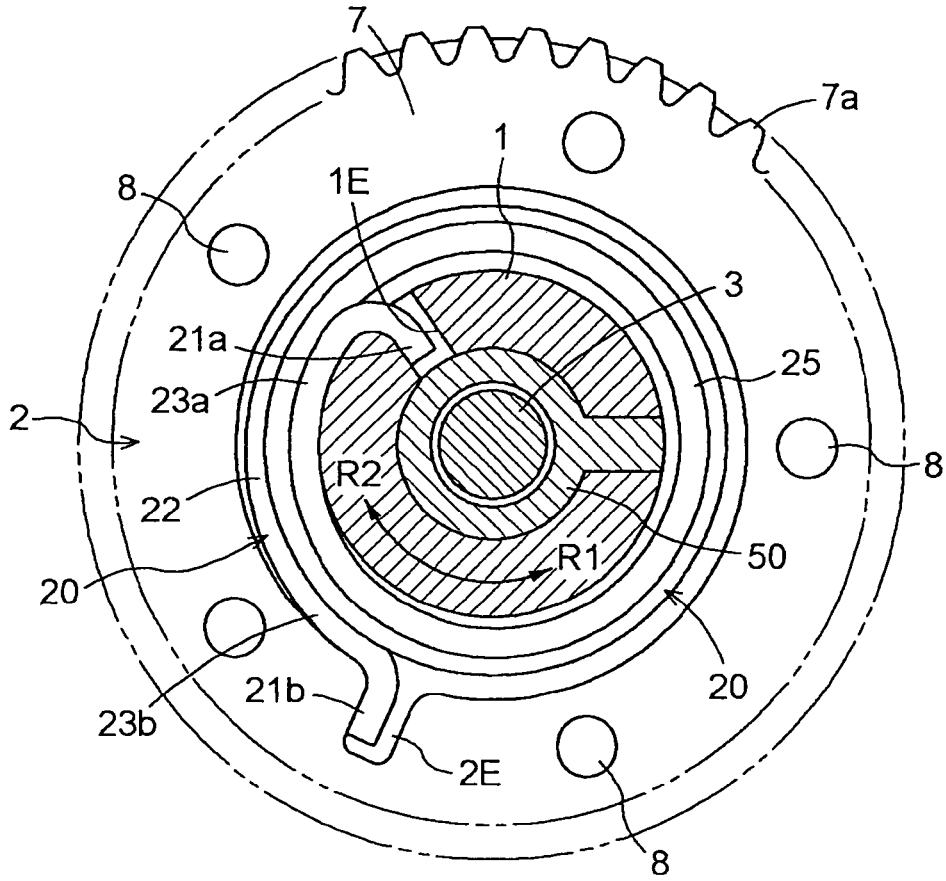
[FIG. 5] a front view in partial section showing a valve timing controlling apparatus relating to a further embodiment and corresponding to FIG. 3.
Figure 6:
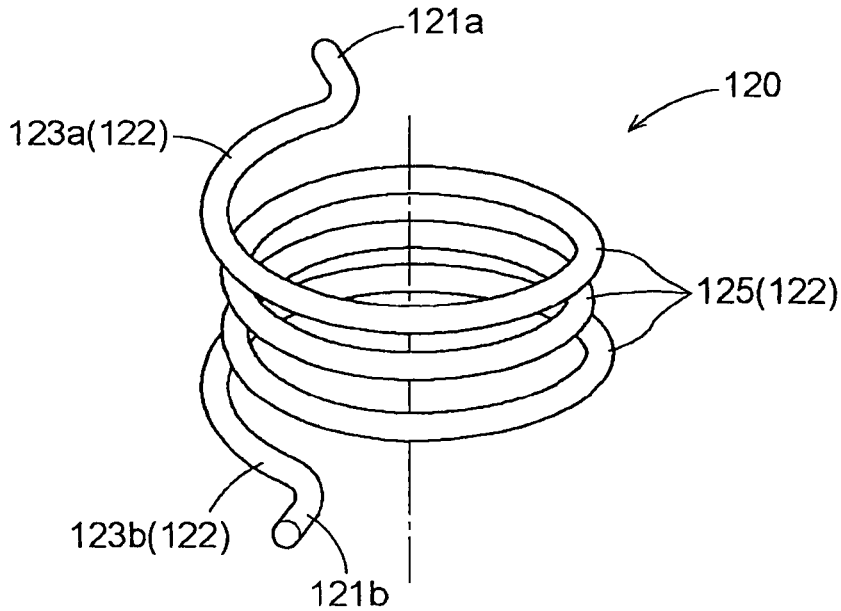
[FIG. 6] a perspective view showing a torsion coil spring relating to a further embodiment.
Figure 7:
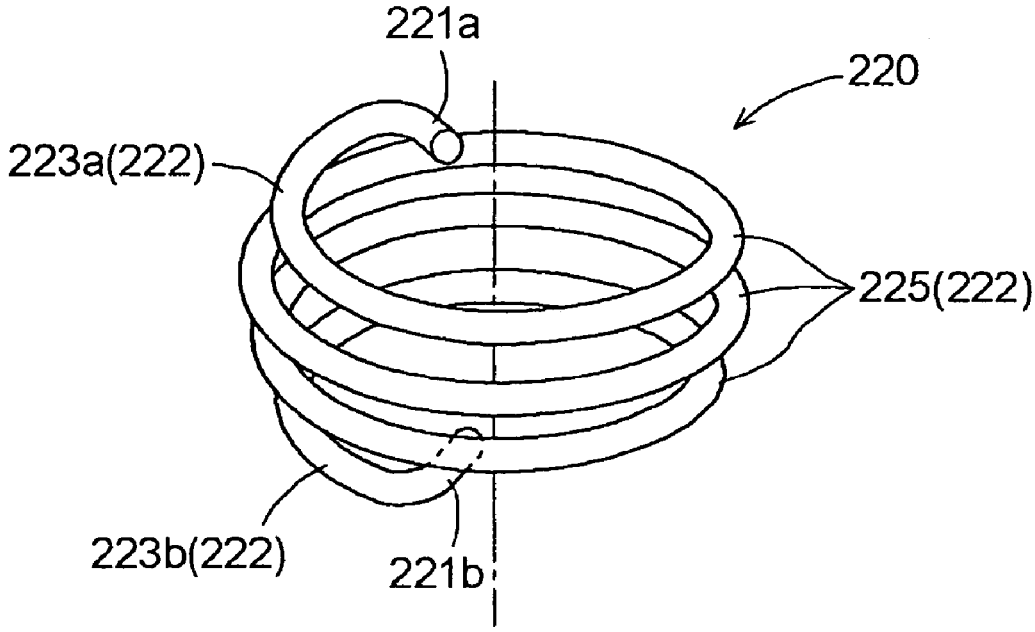
[FIG. 7] a perspective view showing a torsion coil spring relating to a still further embodiment.

50 cam shaft
1 inner rotor (first rotary body)
2 outer rotor (second rotary body)
4 oil feeding boss
5 housing member
6 front plate
7 rear plate
7*a* sprocket portion
10 fluid chamber
10*a* phase advanced angle chamber
10*b* phase retarded angle chamber
12 vane
20 torsion coil spring
21*a* first retaining portion
21*b* second retaining portion
22 coil portion
23*a* first holding area
23*b* second holding area
25 torque generating area

The invention claimed is:

1. A valve timing controlling apparatus comprising:

a first rotary body rotatable with a cam shaft of an internal combustion engine;

a second rotary body rotatable with a crank shaft and rotatable relative to the first rotary body;

a controlling means for varying relative rotational phase between the first rotary body and the second rotary body; and a torsion coil spring for urging the first rotary body relative to the second rotary body in a phase advancing direction;

wherein said torsion coil spring includes a pair of retaining portions to be retained respectively to said first rotary body and said second rotary body and a coil portion disposed between said pair of retaining portions;

wherein said coil portion includes a pair of holding areas extending continuously from said respective retaining portions and capable of fixing said coil portion in position relative to respective peripheral faces of said first rotary body and said second rotary body formed coaxially with a rotational axis of said first and second rotary bodies and includes also a torque generating area disposed between said pair of holding areas, said holding areas and said torque generating area having different coiling diameters from each other; and wherein one of said pair of retaining portions of the torsion coil spring is retained to an outer peripheral face of one of the first and second rotary bodies which is disposed on the inner side of the torsion coil spring; the other retaining portion is retained to an inner peripheral face of the other one of the first and second rotary bodies which is disposed on the outer side of the torsion coil spring; and said torque generating area has a coiling diameter greater than the holding area extending continuously from said one retaining portion retained to said outer peripheral face and smaller than the other holding area extending continuously from the other retaining portion retained to said inner peripheral face.

2. The valve timing controlling apparatus according to claim 1, wherein said pair of holding areas fix said coil portion in position relative to respective peripheral faces of said first rotary body and said second rotary body by coming into contact with the respective peripheral faces of the first rotary body and the second rotary body for a range within one winding from each said retaining portion.

3. The valve timing controlling apparatus according to claim 1, wherein of a plurality of windings forming said torque generating area, adjacent windings adjacent along the axial direction of the torsion coil spring are maintained under a non-contact condition, regardless of a relative positional relationship between said first rotary body and said second rotary body.

4. A valve timing controlling apparatus comprising:

a first rotary body rotatable with a cam shaft of an internal combustion engine;

a second rotary body rotatable with a crank shaft and rotatable relative to the first rotary body;

a controlling means for varying relative rotational phase between the first rotary body and the second rotary body; and a torsion coil spring for urging the first rotary body relative to the second rotary body in a phase advancing direction;

wherein said torsion coil spring includes a pair of retaining portions to be retained respectively to said first rotary body and said second rotary body and a coil portion disposed between said pair of retaining portions;

wherein said coil portion includes a pair of holding areas extending continuously from said respective retaining portions and capable of fixing said coil portion in position relative to respective peripheral faces of said first rotary body and said second rotary body formed coaxially with a rotational axis of said first and second rotary bodies and includes also a torque generating area disposed between said pair of holding areas, said holding areas and said torque generating area having different coiling diameters from each other; and wherein said pair of retaining portions of the torsion coil spring are both retained to the inner peripheral faces of said first and second rotary bodies which are disposed on the outer side of the torsion coil spring; and said torque generating area has a coiling diameter smaller than either one of said pair of holding areas extending continuously from the respective retaining portions.

5. The valve timing controlling apparatus according to claim 4, wherein said pair of holding areas fix said coil portion in position relative to respective peripheral faces of said first rotary body and said second rotary body by coming into contact with the respective peripheral faces of the first rotary body and the second rotary body for a range within one winding from each said retaining portion.

6. The valve timing controlling apparatus according to claim 4, wherein of a plurality of windings forming said torque generating area, adjacent windings adjacent along the axial direction of the torsion coil spring are maintained under a non-contact condition, regardless of a relative positional relationship between said first rotary body and said second rotary body.

* * * * *